US005199707A

United States Patent [19]

Knox

[11] Patent Number: 5,199,707

[45] Date of Patent: Apr. 6, 1993

[54] GOLF CLUB

[76] Inventor: James G. Knox, 324 Dewitt Ct., El Cajon, Calif. 92020

[21] Appl. No.: 891,713

[22] Filed: Jun. 1, 1992

[51] Int. Cl.[5] ..... A63B 53/00; A63B 53/04

[52] U.S. Cl. ..... 273/80 C; 273/78; 273/167 H; 273/167 J; 273/167 F; 273/167 G

[58] Field of Search ..... 273/167-175, 273/77 R, 183 D, 186 A, 164.1, 77 A, 80 A, 80 C

[56] References Cited

U.S. PATENT DOCUMENTS

| | | | |
|---|---|---|---|
| 2,023,885 | 12/1935 | Hinckley | 273/175 X |
| 2,820,638 | 1/1958 | Morrison | 273/164 |
| 2,926,913 | 3/1960 | Stecher | 273/167 G X |
| 3,693,978 | 9/1972 | East | 273/167 G X |
| 3,814,437 | 6/1974 | Winquist | 273/167 H X |
| 4,367,878 | 1/1983 | Schmidt | 273/167 H X |
| 4,438,931 | 3/1984 | Motomiya | 273/167 H |
| 4,826,172 | 5/1989 | Antonious | 273/167 H X |
| 4,852,879 | 8/1989 | Collins | 273/80 A X |
| 5,014,993 | 5/1991 | Antonious | 273/167 H X |
| 5,046,733 | 9/1991 | Antonious | 273/167 H X |

FOREIGN PATENT DOCUMENTS

| | | | |
|---|---|---|---|
| 2185690 | 7/1987 | United Kingdom | 273/80 A |
| 2217611 | 11/1989 | United Kingdom | 273/167 H |

OTHER PUBLICATIONS

Austand's Spring 1991 Catalog, Feb. 1991 Issue, "Spalding's Tour Edition Clubs".

*Primary Examiner*—Mark Graham
*Assistant Examiner*—Sebastiano Passaniti
*Attorney, Agent, or Firm*—Charles C. Logan, II

[57] ABSTRACT

A golf club having a shaft whose longitudinally extending axis passes through the center of gravity or "sweet spot" of the golf club head. The center of gravity is equally spaced from the heel and toe of the golf club head and also equally spaced from its top edge and bottom edge. The front surface of the golf club head has a concave curvature only in its horizontal axis. The center of gravity of the golf club head is also centrally positioned between its front and its rear surface.

6 Claims, 1 Drawing Sheet

GOLF CLUB

BACKGROUND OF THE INVENTION

The invention relates to a golf club and more specifically to a golf club having a shaft whose longitudinal axis passes through the center of gravity of the golf club head.

The basic design of a golf club such as an iron or a wood has been historically designed with the center of gravity of the golf head located at a point somewhere between 2 to 3 inches from the longitudinal axis of the golf club shaft. One of the inherent problems of this design is the fact that a person swinging the club is not allowed to benefit from his natural hand/eye coordination because the axis upon which his hands are holding the golf club are laterally offset from the center of gravity of the golf club head which is where the golf ball is ideally struck. The golfer therefore must necessarily learn to adjust his swing arc to take into account this particular lateral offset spacing of the center of gravity of the golf club head.

Also the natural centrifugal force of a swinging golf club is at the end of the shaft along its longitudinal axis and not 2 inches away. An additional loss of power results when the hands cannot hold a golf club absolutely still when the object being hit is not in alignment with the end of the shaft. Even if the club were held in a rigid vice, this would still be true to some measurable extent. Due to the torsional effect of the club head rotating there will be a loss of power from the swing of the golfer that translates into the ball going a shorter distance than its effective potential and off target to the degree that the club shifts on the perpendicular relative to the direction of the force and the intended flight of the ball.

It is an object of the invention to provide a novel golf club whose shaft has its longitudinal axis traveling down through the center of gravity of the golf club head.

It is also an object of the invention to provide a novel golf club that maximizes the amount of power that can be transmitted from the swing of the golfers arms to the center of gravity of the golf club head.

It is also an object of the invention to provide a novel golf club that is designed in such a manner that it eliminates the tendency for the club head to torsionally rotate during the swinging motion.

It is another object of the invention to provide a novel golf club that allows a golfer to increase his natural hand/eye coordination during his swing since the center of gravity of the golf club head lies on the longitudinal axis of the shaft.

It is an additional object of the invention to provide a novel golf club that will allow more golfers to strike the ball more solidly and therefore travel farther.

It is a further object of the invention to provide a novel golf club whose front surface of its club head has been designed to minimize the distance laterally off target of miss hit balls that have been struck fore or aft of the center of gravity of the golf club head.

SUMMARY OF THE INVENTION

The novel improved golf club has the longitudinal axis of its shaft passing through the center of gravity or "sweet spot" of the golf club head. The center of gravity of the golf club head is located an equal distance from its heel and toe and also an equal distance from the top edge and bottom edge of the club head. Additionally, the center of gravity is positioned an equal distance from the front surface of the golf club head to its rear surface.

The rear surface of the golf club head has a ⅜ inch flange surrounding a cavity that is bridged by a center rib which is an extension of the hozzle. The center rib is positioned behind the sweet spot on the front surface of the club head. Also formed on the back surface of the club head is a front claw portion, a middle claw portion and a rear claw portion that give the appearance of the design of an eagle's claw.

By having the longitudinal axis of the golf club shaft passing through the center of gravity of the golf club head, the golfer while swinging, is allowed to use his natural hand/eye coordination. This also eliminates much of the torsional rotation of the club head since the center of gravity of the club head is not laterally spaced 2 to 3 inches away from the longitudinal axis of the shaft. It allows the golf ball to be hit more solidly and therefore travel farther and more accurately when miss hit or hit to some degree off the "sweet spot" or exact center of gravity. Further it allows the natural centrifugal force produced during the swinging of a golf club to remain at the end of a shaft on its longitudinal axis.

The front surface of the club head has a slight concave curvature on the horizontal axis that helps minimize the ill effects of shots that have not placed the center of gravity of the club head on the golf ball. Swinging mistakes will be positively modified in a favorable way because the distance off the target of the miss hit golf shot will be less from the center poised club shaft. Heel or toe hits will still be closer to the target. The center of a poised club will be much more forgiving of a loosely held club. It is essentially an anti-twist design. The club will not correct for hand movements but it will deemphasize the poor result. The center-poised shaft with the "sweet spot" will cause off line shots to go much closer to the intended line. The neck or hozzle of the club head is reinforced with a bridge or a vertical rib across the heart of the club head rear surface, leaving the rim-supported and drum-rebound effect of hollow back design. The golf club has a totally unique shape to increase balance fore and aft of the shaft and to distribute hitting area and weight equally to compensate for small mechanical errors.

DESCRIPTION OF THE PREFERRED EMBODIMENT

Figure 1:
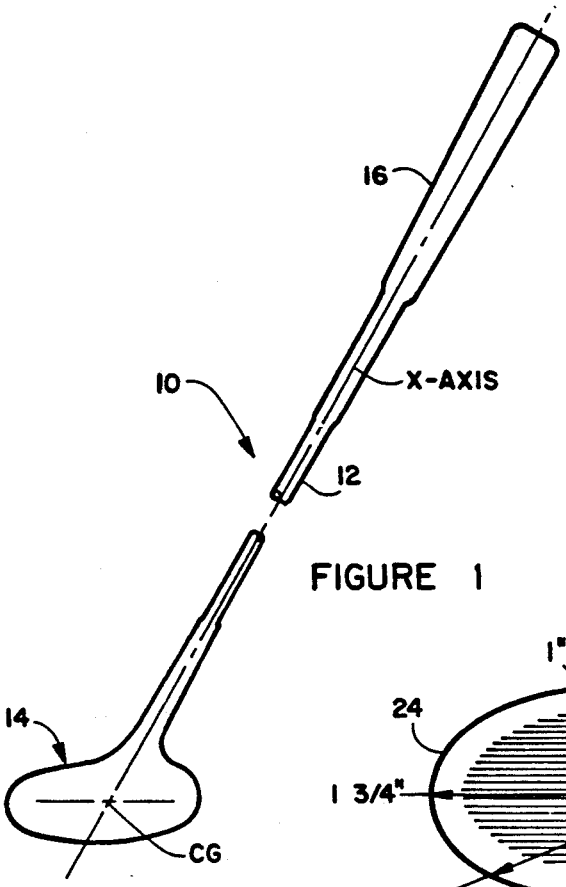
FIG. 1 is a front elevation view of the novel golf club.
Figure 2:
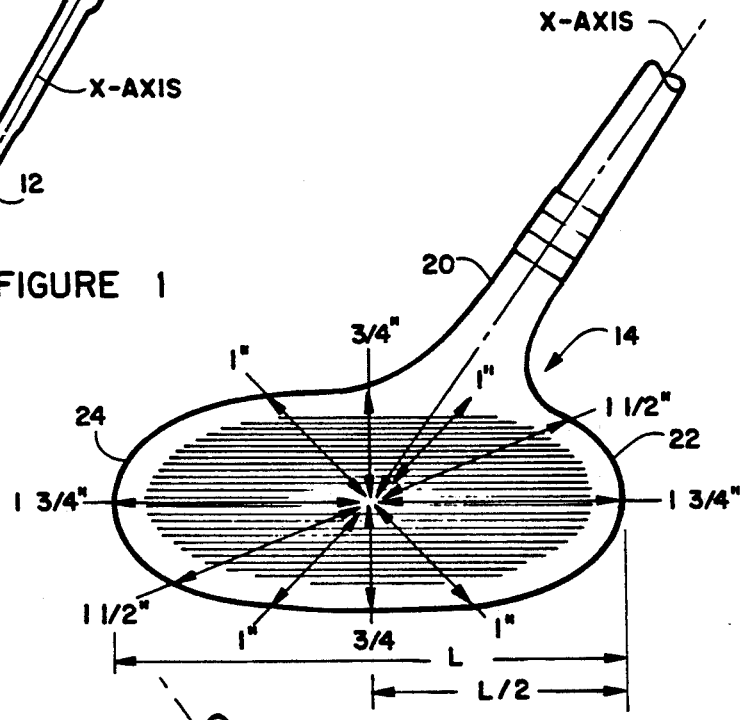
FIG. 2 is a front elevation view of the golf club head.
Figure 3:
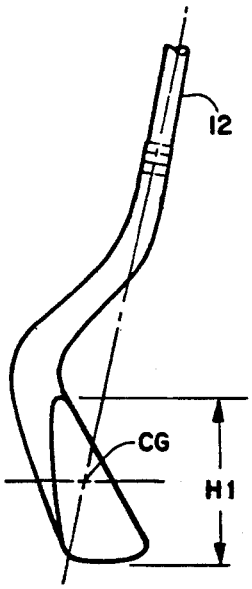
FIG. 3 is a side elevation view of the golf club head.
Figure 4:
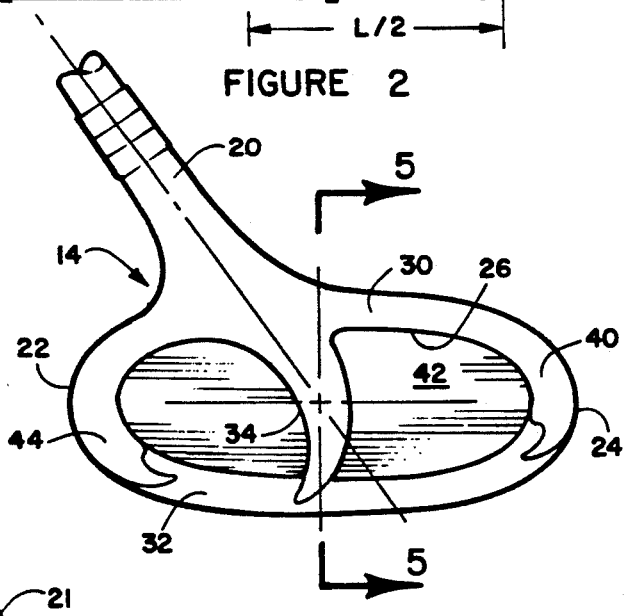
FIG. 4 is a rear elevation view of the golf club head.
Figure 5:
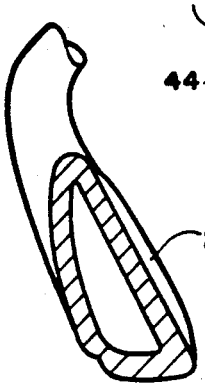
FIG. 5 is a cross-sectional view taken along lines 5—5 of FIG. 4.

The novel golf club will now be described by referring to FIGS. 1-5 of the drawing. The golf club is ordinarily designated numeral 10. It has a shaft 12 and a golf club head 14. Shaft 12 has a longitudinally extending X-axis. A grip 16 is mounted on the top end of shaft 12. Longitudinal X-axis passes through the center of gravity of club head 14.

Club head 14 has a serpentine shaped hozzle or tubular neck portion 20 and a front hitting surface 21. It has a heel 22 and a toe 24. A cavity 28 is formed in the rear surface of club head 14. It forms a top flange 30 and a bottom flange 32. The cavity has a bridge member in the form of a vertical center rib 34. The rear of the club head also has a front claw portion 40, and a rear claw portion 44. Bridge member 34 is also configured as a middle claw portion. The club head has a length L and the center of gravity is located at L/2. The club head is symmetrical and is shown drawn to scale in FIG. 2.

What is claimed is:

1. An iron type golf club comprising:

an elongated golf club shaft having a top end, a bottom end and a longitudinally extending axis;

an iron type golf club head having an elongated neck portion having a tubular top end for receiving the bottom end of said golf club shaft, the top end of said neck portion having a longitudinally extending axis that aligns with the longitudinal axis of said golf club shaft;

said golf club head having a center of gravity that lies substantially on the longitudinal axis of said golf club shaft;

said golf club head having a toe, a heel, a front surface and a rear surface; and a cavity being formed in the rear surface of said golf club head by a respective vertically spaced rearwardly extending top flange and a rearwardly extending bottom flange of said golf club head, a vertical bridge member extending from said neck portion and connecting said rearwardly extending top flange to said rearwardly extending bottom flange, said bridge member being rearwardly spaced from said rear surface so that the front surface of the club head can recoil and then spring forward as it strikes a golf ball.

2. A golf club as recited in claim 1 wherein said bridge member is located behind said center of gravity.

3. A golf club as recited in claim 1 wherein said golf club head has a length L from said heel to said toe and the center of gravity of the golf club head is located a distance L/2 relative to said heel.

4. A golf club as recited in claim 1 wherein the front surface of said golf club head has a concave curvature along a horizontal axis extending from said heel to said toe.

5. A golf club iron as recited in claim 1 wherein said neck portion has a serpentine configuration including an intermediate portion that is curved rearwardly of the longitudinal axis of said golf club shaft and also rearwardly of said golf club head.

6. A golf club iron as recited in claim 1 further comprising a front claw portion and a rear claw portion on the rear surface of said golf club head and said bridge member being configured as a middle claw portion.

* * * * *